US009848722B1

(12) United States Patent
Lopynski

(10) Patent No.: US 9,848,722 B1
(45) Date of Patent: Dec. 26, 2017

(54) CONTAINER ASSEMBLY WITH A LID AND THE LID THEREOF THAT ALLOW FOR DRINKING FROM THE SIDE

(71) Applicant: John J. Lopynski, Clifton, VA (US)

(72) Inventor: John J. Lopynski, Clifton, VA (US)

( * ) Notice: Subject to any disclaimer, the term of this patent is extended or adjusted under 35 U.S.C. 154(b) by 0 days.

(21) Appl. No.: 15/405,207

(22) Filed: Jan. 12, 2017

Related U.S. Application Data

(60) Provisional application No. 62/441,171, filed on Dec. 31, 2016.

(51) Int. Cl.

| | |
|---|---|
| ***A47G 19/22*** | (2006.01) |
| ***B65D 43/02*** | (2006.01) |
| ***B65D 55/16*** | (2006.01) |
| ***B65D 47/32*** | (2006.01) |
| ***B65D 53/02*** | (2006.01) |

(52) U.S. Cl.
CPC ..... *A47G 19/2272* (2013.01); *B65D 43/0225* (2013.01); *B65D 47/32* (2013.01); *B65D 53/02* (2013.01); *B65D 55/16* (2013.01); *B65D 2543/00046* (2013.01)

(58) Field of Classification Search
CPC ..... A47G 19/2272; A47G 19/2266; B65D 43/0225; B65D 43/0202; B65D 43/02; B65D 47/32; B65D 47/12; B65D 47/22; B65D 53/02; B65D 55/16; B65D 25/48
USPC .... 220/713, 717, 711, 716, 703, 367.1, 709; 222/547, 567, 544, 568, 566, 465.1, 470, 222/469; 137/800
See application file for complete search history.

(56) References Cited

U.S. PATENT DOCUMENTS

| | | | | |
|---|---|---|---|---|
| 3,104,786 | A * | 9/1963 | Sanchis | B65D 47/06 222/481 |
| 4,146,157 | A * | 3/1979 | Dixon, Sr. | A47G 19/2272 220/703 |
| 5,050,759 | A * | 9/1991 | Marble | A47G 19/2272 220/603 |
| 5,325,996 | A * | 7/1994 | Bannigan | A47G 19/12 222/129 |
| 5,337,918 | A * | 8/1994 | Wang | A47G 19/2266 215/229 |
| 5,477,994 | A * | 12/1995 | Feer | B65D 47/305 137/846 |
| 5,579,948 | A * | 12/1996 | Lin | A47G 19/2266 215/229 |
| 8,011,521 | B2 | 9/2011 | Clark | |
| D671,359 | S * | 11/2012 | Windmiller | D7/392.1 |
| 8,672,174 | B1 | 3/2014 | McMullin | |
| D708,888 | S * | 7/2014 | Duran | D7/317 |
| 9,315,307 | B2 * | 4/2016 | Akaogi | B65D 51/18 |
| 2008/0000866 | A1 | 1/2008 | Yates, III | |
| 2013/0146620 | A1 | 6/2013 | Ghezelayagh | |

(Continued)

*Primary Examiner* — Robert J Hicks
(74) *Attorney, Agent, or Firm* — Rossi, Kimms & McDowell LLP

(57) ABSTRACT

A beverage container assembly has a container with an opening and a lid that closes the opening. The lid has a mouthpiece that extends laterally outwardly of the container to allow a person's head to remain upright or erect (i.e., minimizing or no head tilt movement) while drinking so as to not impede the user's straight-ahead vision, such as while driving. The mouthpiece is configured so that the container becomes disposed at one side of the nose so that the container is tiltable further as the nose does not interfere with the tilting action.

20 Claims, 16 Drawing Sheets

(56) References Cited

U.S. PATENT DOCUMENTS

| | | | |
|---|---|---|---|
| 2015/0353259 | A1 | 12/2015 | Burden |
| 2016/0051069 | A1 | 2/2016 | Turner et al. |

* cited by examiner

FIG. 2
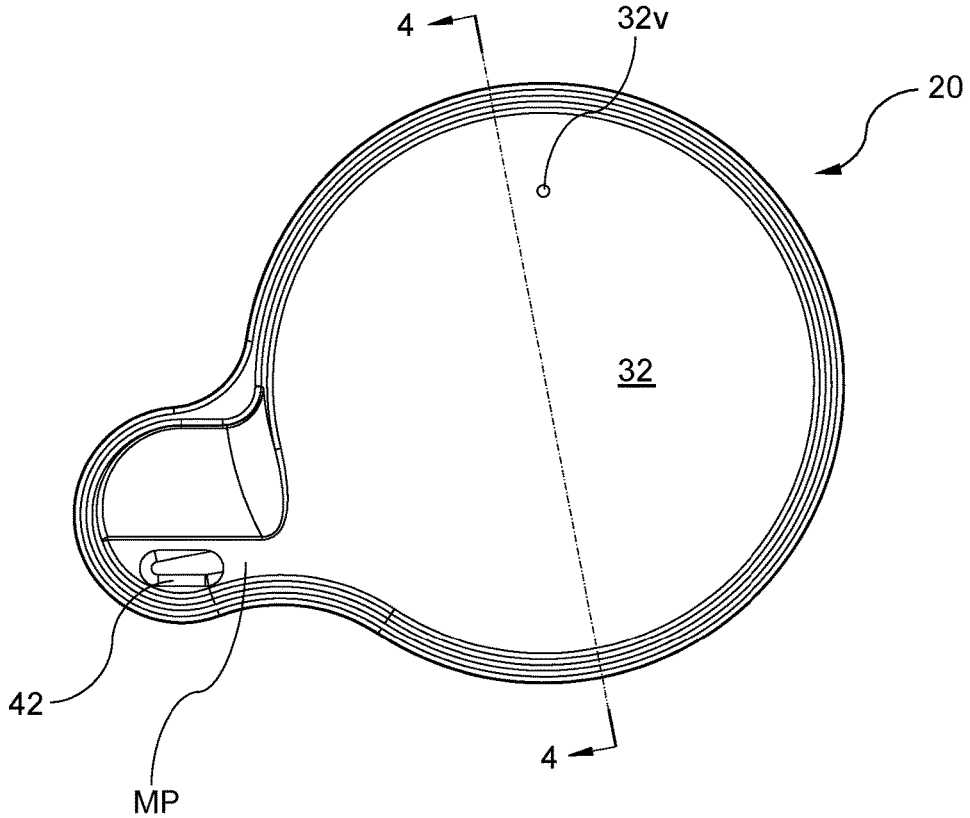
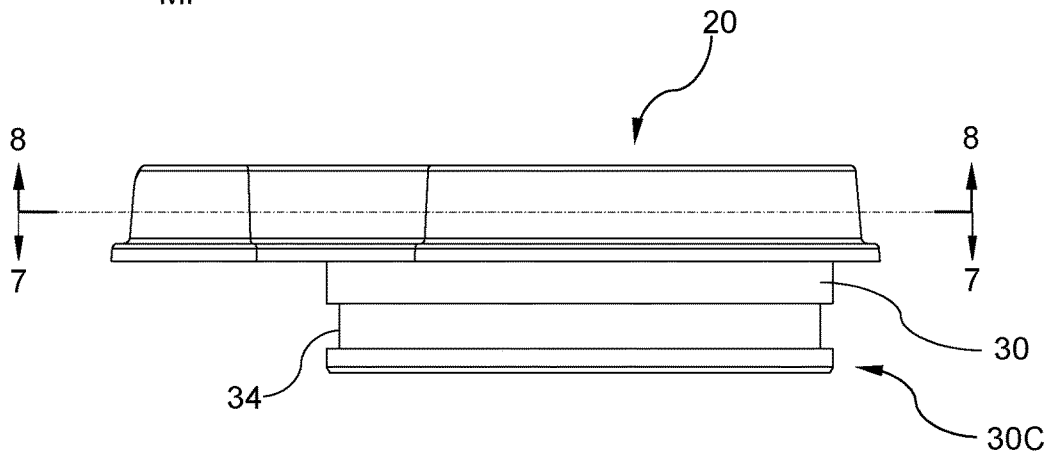
FIG. 3

FIG. 4
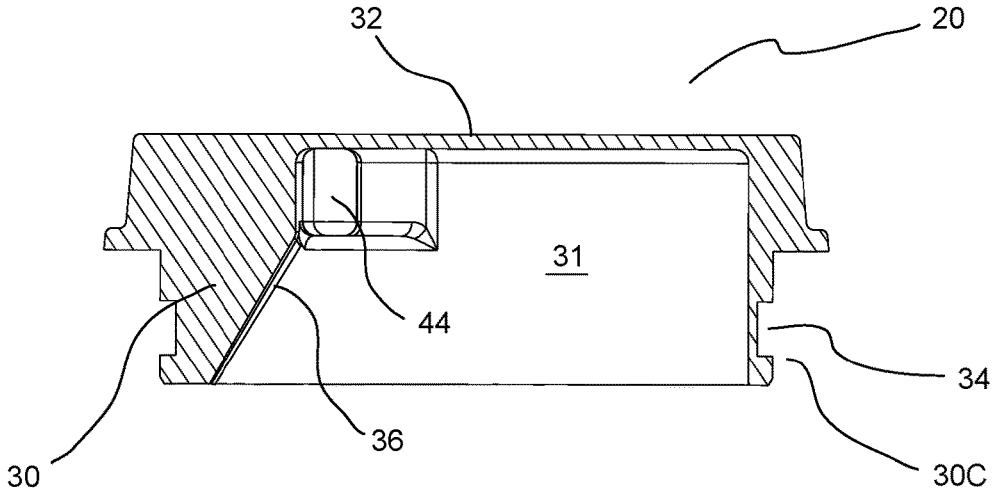
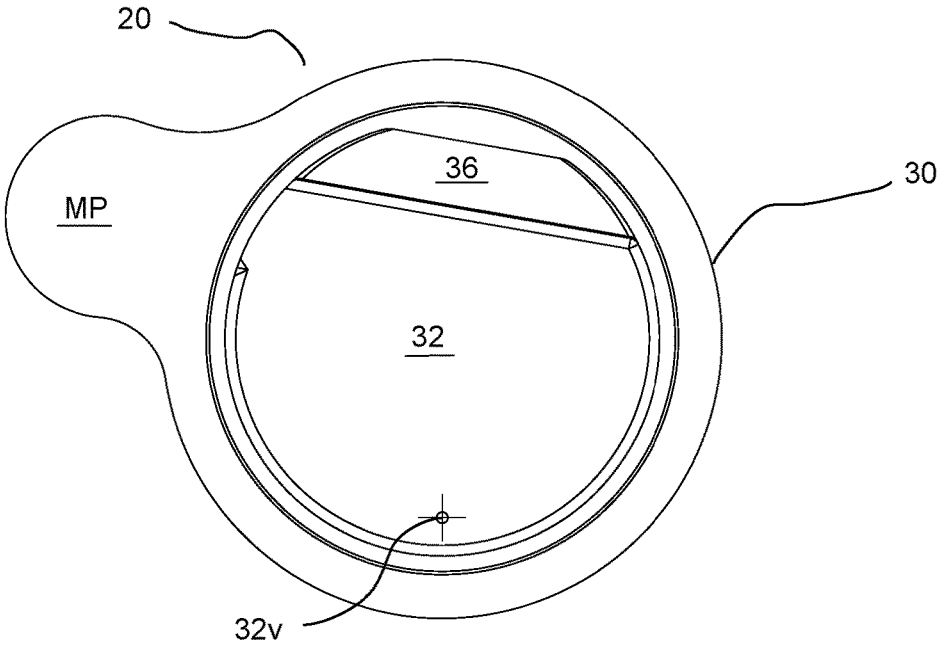
FIG. 6

FIG. 7
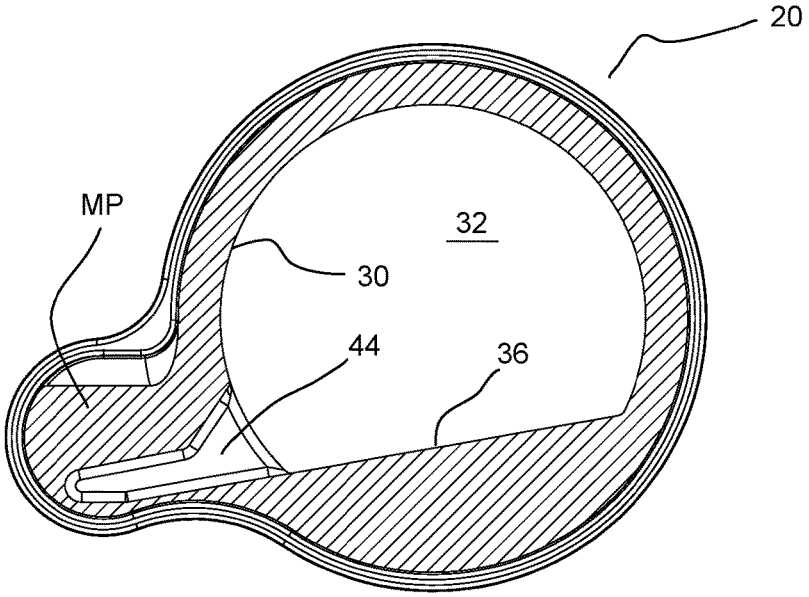
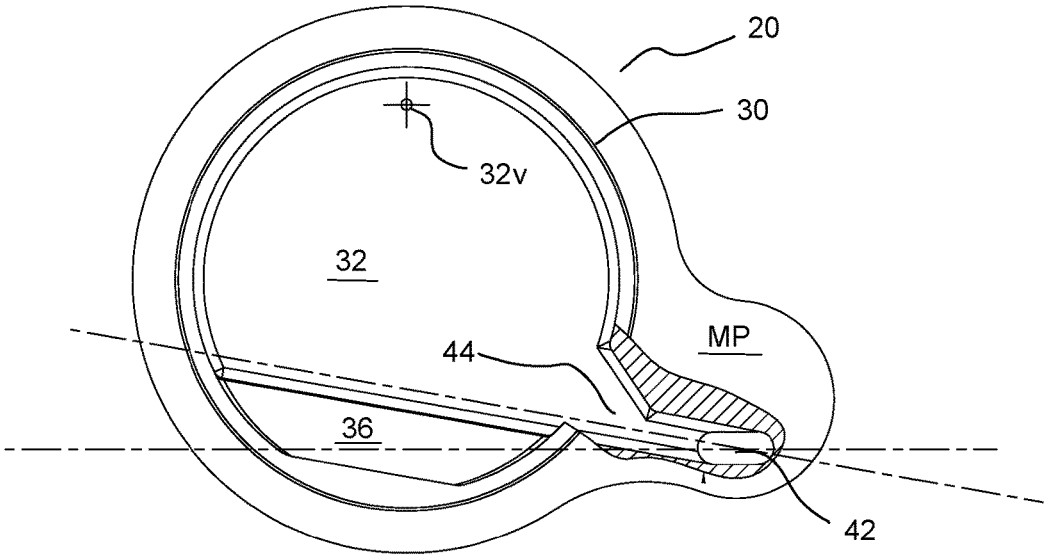
FIG. 8

FIG.9
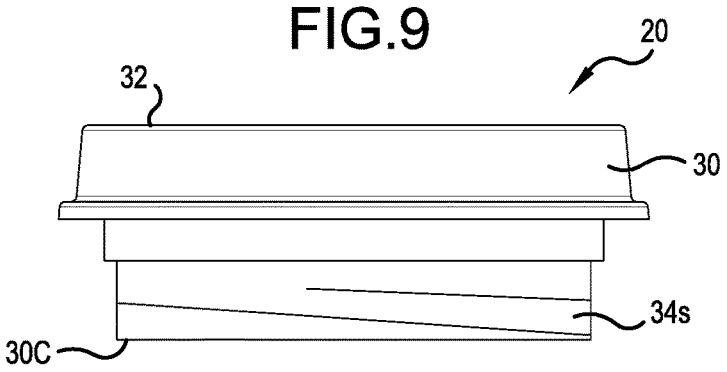
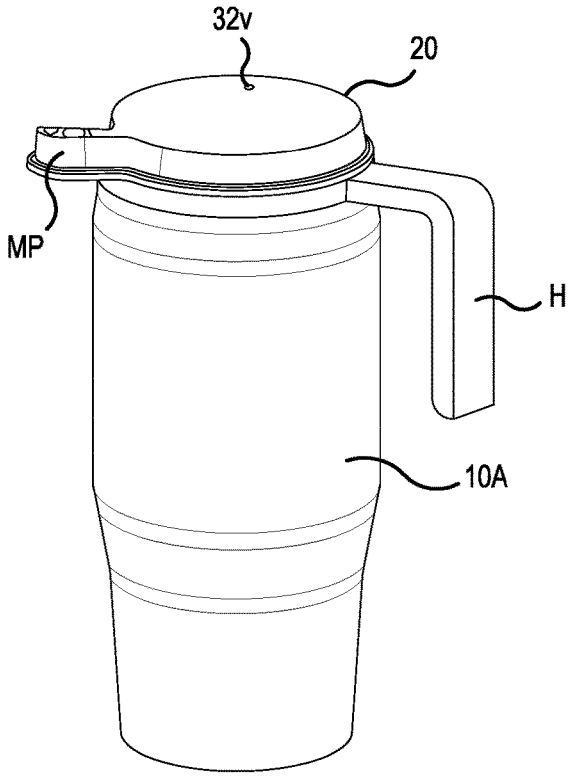
FIG.10

FIG. 11
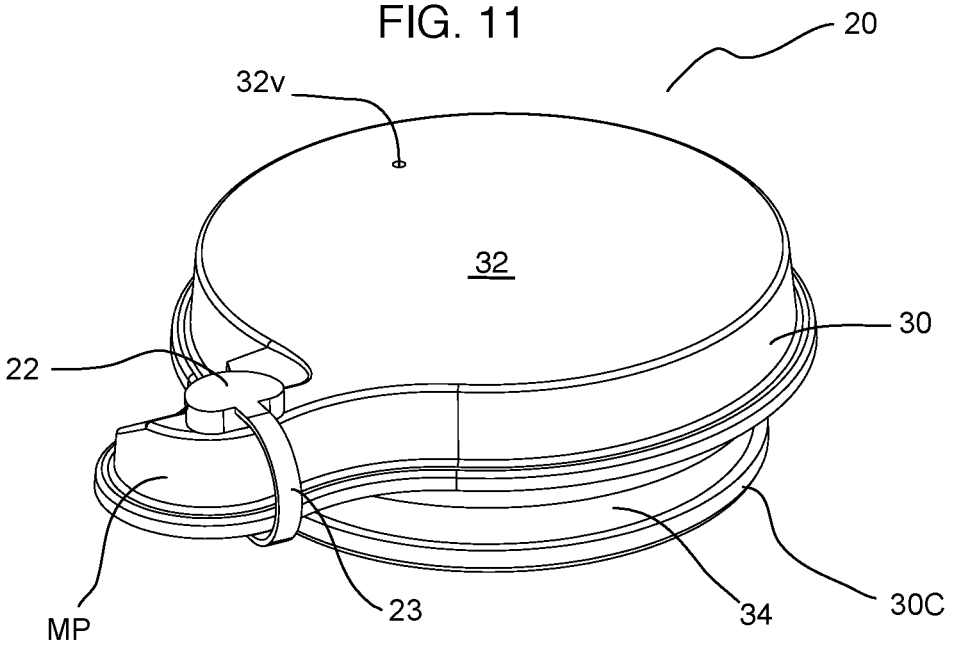
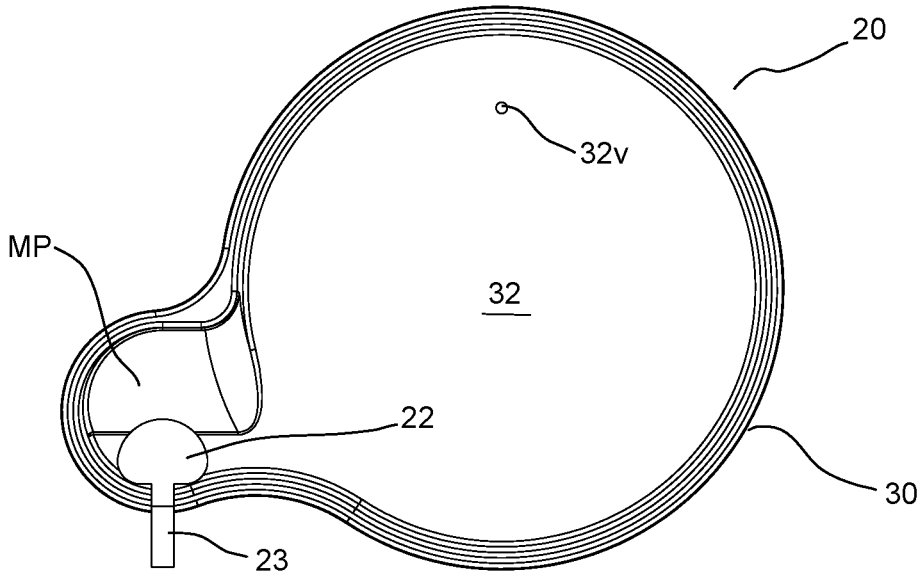
FIG. 12

FIG. 13
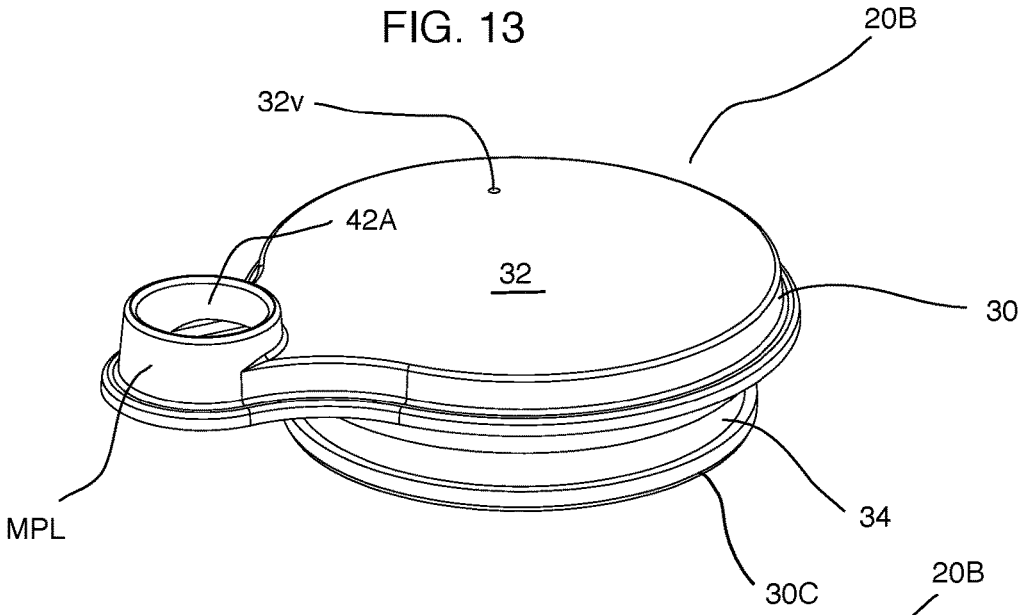
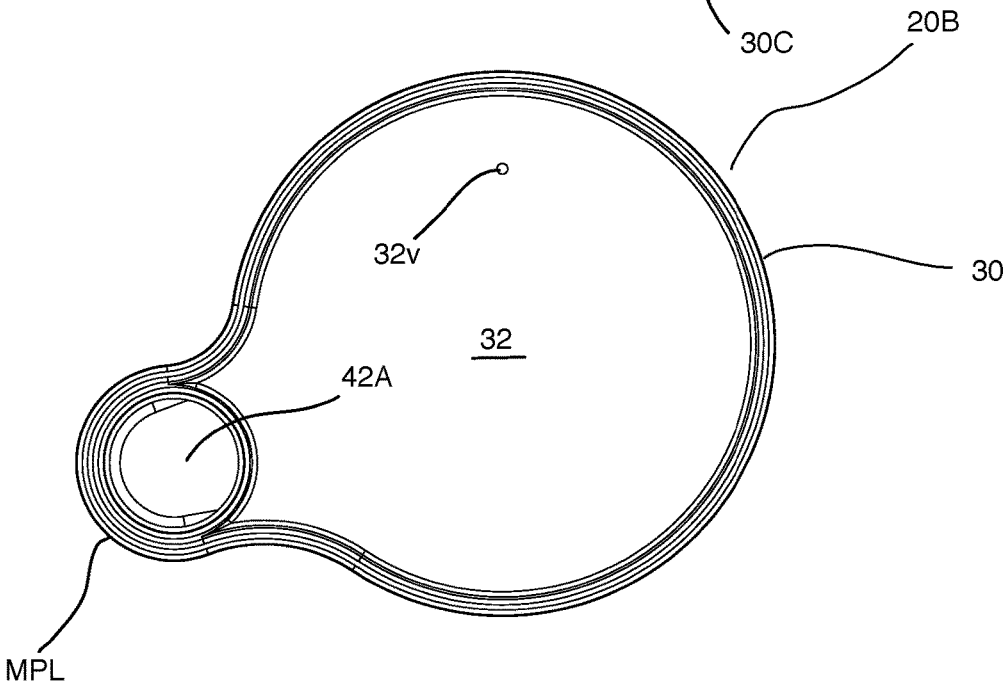
FIG. 14

FIG. 15
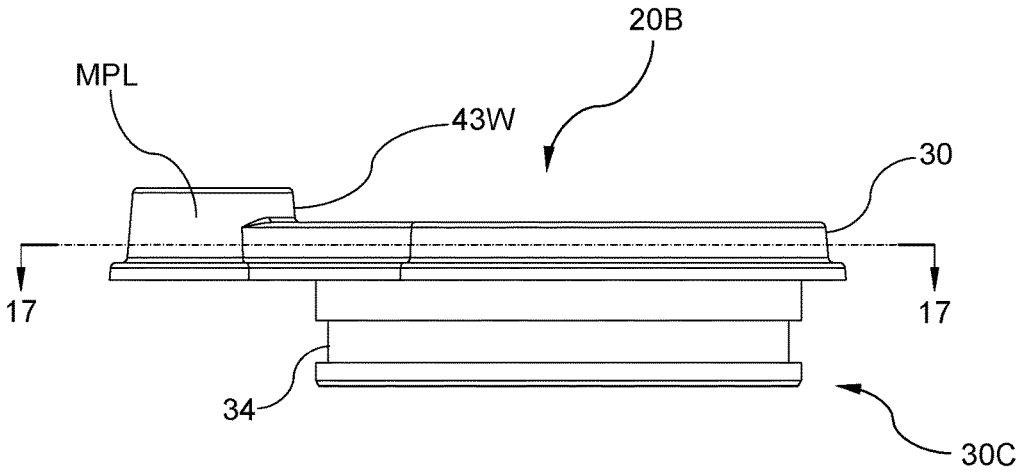
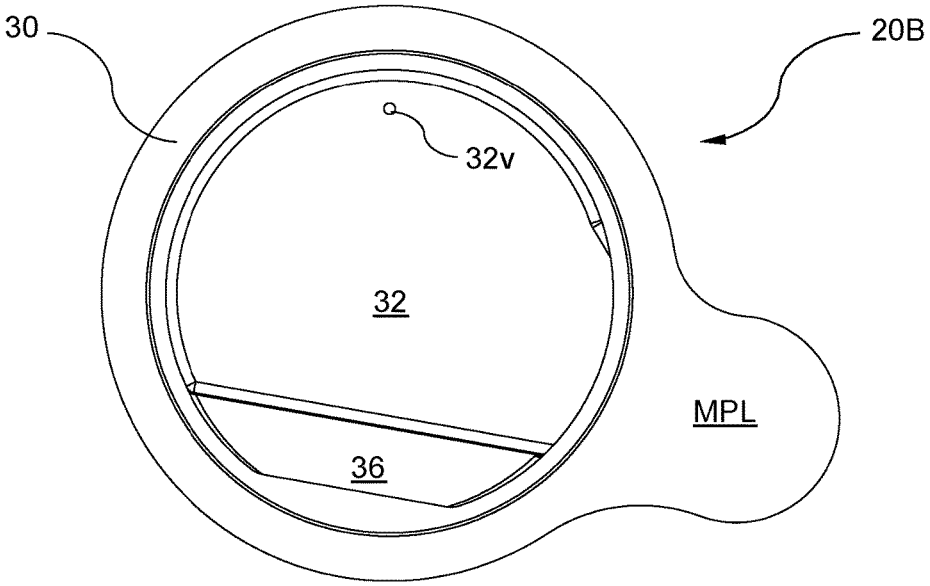
FIG. 16

FIG. 17
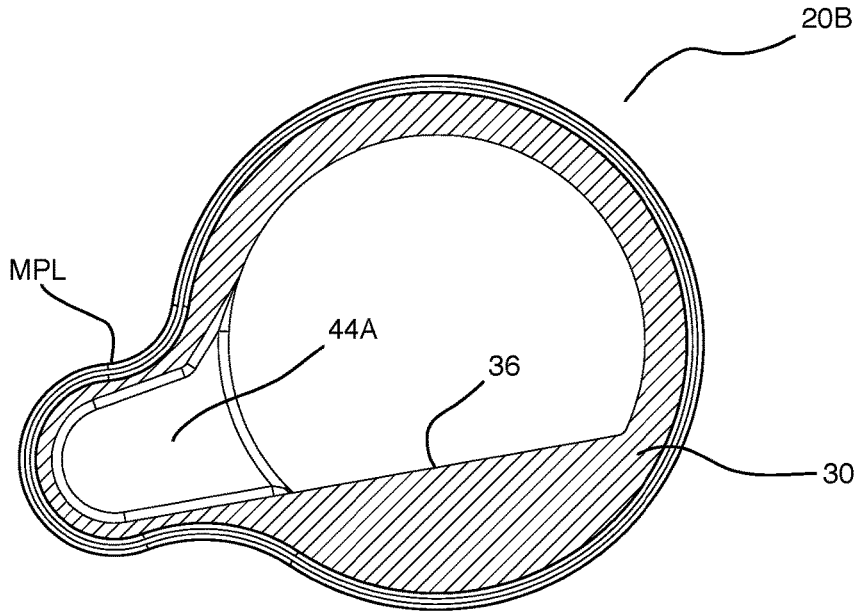
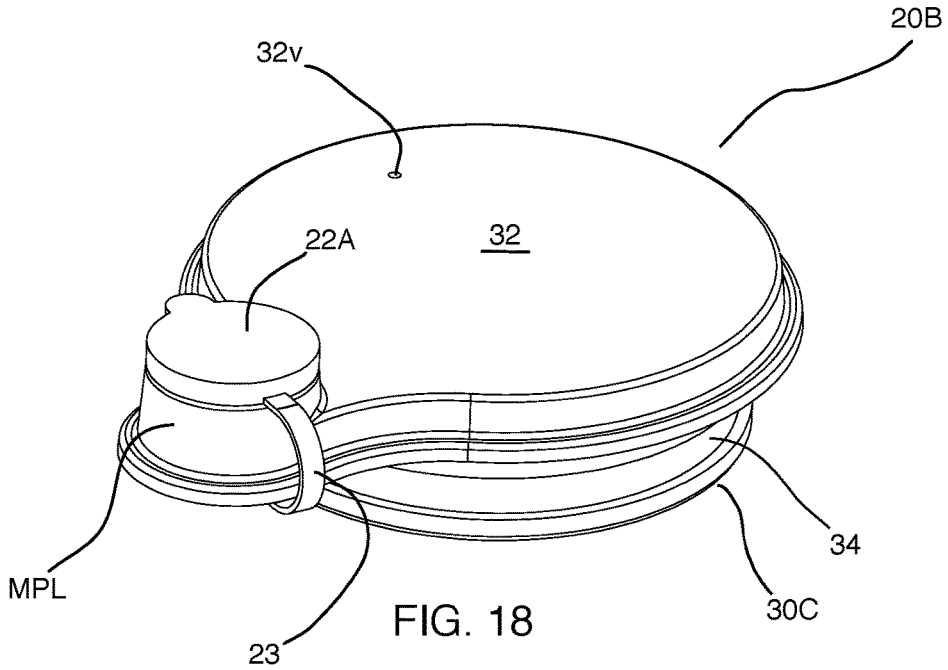
FIG. 18

CONTAINER ASSEMBLY WITH A LID AND THE LID THEREOF THAT ALLOW FOR DRINKING FROM THE SIDE

BACKGROUND

The National Highway Traffic Safety Administration (NHTSA) reported in July 2016 that an estimated 35,200 people were killed on the road in 2015, up 7.7 percent from 32,675 in 2014. According to a study by the Exxon Mobile Corporation, 83% of American drivers drink nonalcoholic beverages while driving. A study done by the National Highway Traffic Safety Administration (NHTSA) concluded that those who eat and drive increase the odds of an accident by 80%. Distractions, like eating, can become problematic for drivers as it hinders the drivers' ability to quickly react to situations, such as a sharp curve according to a study by the NHTSA. This study has ranked the worst foods to eat behind the wheel based on a survey of drivers. Coffee, which is the most often consumed beverage in vehicles, is deemed the worst, bringing new meaning to the adage "don't drink and drive."

FIGS. 20A-22B illustrate schematic front and side views of the driver's head when drinking from conventional drinking containers. FIGS. 20A and 20B illustrate the angle of the container in relation to the drinker's head when the drink starts to flow. FIGS. 21A and 21B illustrate the angle of the container in relation to the drinker's head when the drink enters the drinker's mouth and the nose is touching the container's top. FIGS. 22A and 22B illustrate the drinker's head tilting back to finish the drink. From the beginning of the drink to the tilting of the head, the drinker's vision becomes blocked.

When a driver consumes beverage from conventional drink containers, it is nearly impossible for the driver to keep his or her eyes on the road due to the drink container needing to be in front of the driver's face and requiring the driver to tilt his/her head back to drink, namely to avoid the container hitting the driver's nose on the container or to avoid spilling. Even if the drink container is configured to slope to minimize nose contact, it is still disposed in front of the driver.

There is a dire need to make driving safe while consuming beverages. The present invention addresses this need.

SUMMARY

One aspect of the present invention is a lid that can be used with conventional beverage containers. The lid includes an annular body and a mouthpiece extending laterally outwardly from a side of the annular body and having drink opening. The mouthpiece can be integral with the annular body. The annular body has a closed upper end and an open lower end to define a chamber. A channel is disposed in at least one of the annular body or the mouthpiece, and extends between the drink opening and the chamber to fluidly communicate between the drink opening and the chamber. The drink opening is disposed substantially perpendicular to a longitudinal direction of the channel.

The channel can have a first open end facing the chamber and a second open end that communicates with the drink opening. The drink opening can open in a first direction extending between the closed upper end and the open lower end. The first and second open ends can be disposed substantially perpendicular to each other. The channel can be funnel shaped, with the first open end being wider than the second open end. The drink opening can be elongated and the elongation direction of the drink opening can be angled relative to the longitudinal direction of the channel.

The lid can include a ramp, which can be disposed in the annular body. The ramp has a sloping surface that slopes relative to a first direction extending between the closed upper end and the open lower end of the annular body. The side wall thickness of the annular body can increase along the first direction, from the open lower end toward the channel, to provide the sloping surface. The first open end of the channel can be disposed adjacent to and laterally on one side the ramp to permit liquid to flow substantially sideways in relation to the first direction.

The lid can include a coupling configured to removably and sealingly attach the annular body, from the side of the open lower end, to a wall of an opening of a container. The chamber can face the opening of the container when the annular body is attached to the wall of the container. The mouthpiece is configured to allow the container to be tilted upwardly relative to the mouthpiece so that the container becomes positioned at one side of a drinker's nose while consuming liquid through the mouthpiece.

Another aspect is a beverage container assembly that includes a container and the lid described above.

BRIEF DESCRIPTION OF THE DRAWINGS

FIG. 2 illustrates a top view of the lid shown in FIG. 1.

FIG. 3 illustrates a front elevational view of the lid, which uses a push-mount configuration, illustrated in FIG. 1.

FIG. 4 illustrates an elevational cross-sectional view taken along the line 4-4 in FIG. 2.

FIG. 6 illustrates a bottom view of the lid shown in FIG. 1.

FIG. 7 illustrates a cross-sectional view taken along the line 7-7 in FIG. 3.

FIG. 8 illustrates a cross-sectional view taken along the line 8-8 in FIG. 3.

FIG. 9 illustrates an alternate embodiment of the lid that uses a screw-mount configuration instead of the push-mount configuration.

FIG. 10 illustrates a beverage container similar to FIG. 1, but having a handle.

FIG. 11 illustrates a perspective view of the lid of FIG. 1, with a cap for protecting the drink opening.

FIG. 12 illustrates a top view of the lid shown in FIG. 11.

FIG. 13 illustrates a perspective view of a lid of another embodiment having a larger drink opening suitable for pouring room temperature and cooled liquid.

FIG. 14 illustrates a top view of the lid shown in FIG. 13.

FIG. 15 illustrates a front elevational view of the lid shown in FIG. 13.

FIG. 16 illustrates a bottom view of the lid shown in FIG. 13.

FIG. 17 illustrates a cross-sectional view taken along the line 17-17 in FIG. 15.

FIG. 18 illustrates a perspective view of the lid of FIG. 13, with a cap for protecting the drink opening.

DETAILED DESCRIPTION

One notable feature of the present development is that the beverage being consumed is poured in the mouth, as opposed to using suction, such as using a straw or spout or similar implementation. People generally have an aversion to sucking hot beverages, and even to cold beverages for some, thus avoid using a straw. Another notable feature allows a person to keep his/her head upright, such as while driving to keep his/her eyes on the road while consuming beverage. This is achieved by disposing the beverage container offset from the nose, i.e., on the side of the nose, so that the nose does not interfere with the container while drinking, while maintaining almost full forward visibility. That is, the drinking container is disposed on one side of the nose or head so that the head may remain upright in the driving position without the need to tilt the head as the nose will not interfere with the container. The drinking motion would remain the same as if it were in front of the face but to one side of the nose.

Figure 1:
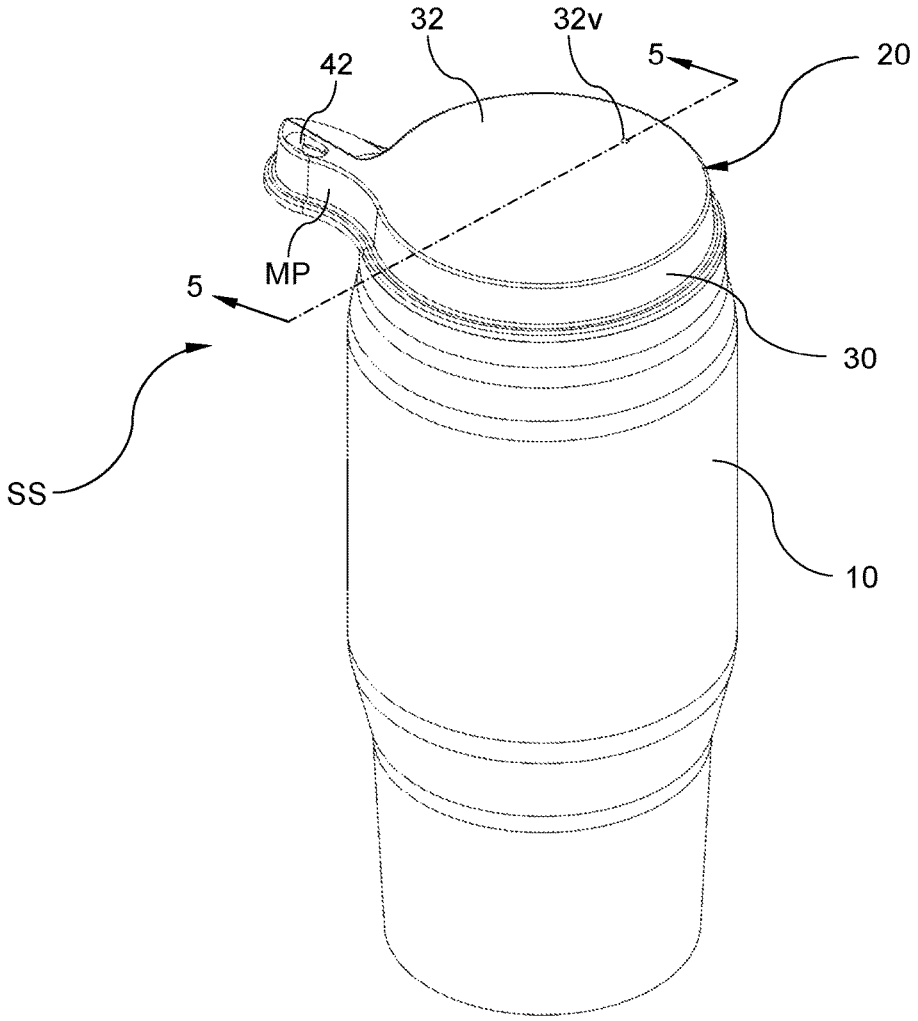
FIG. 1 illustrates a perspective view of one embodiment of a beverage container assembly that allows for drinking from the side.

Referring to FIG. 1, which illustrates perspective view of an embodiment of a beverage container assembly SS that allows for drinking from one side, the assembly SS includes a uniquely configured lid 20 and a conventional beverage container or vessel 10, such as a tumbler. The beverage container can be any commercially available container, whether insulated or not, suitable for holding hot and/or cold beverages, such as coffee, tea, soda, water, juice, etc. The container 10A itself can have a handle H as illustrated in FIG. 10, which illustrates an alternate embodiment of the container 10 shown in FIG. 1. The handle H can be detachably attach or can be integrally formed with the container 10A, and is configured so that it can be comfortably held with one hand. The handle can also serve to dispose the hand further away from the container so as to not block the view of the person consuming the beverage.

Referring to FIGS. 2-3, which respectively show the top view and the front elevational view of the lid shown in FIG. 1, the lid 20 includes a mouthpiece MP having a portion that comes into contact with the person's mouth. The mouthpiece MP extends laterally outwardly from a side of the annular body and has a drink opening 42. The mouthpiece MP is configured so that when the lid is placed on the container, the mouthpiece MP extends outwardly from a side of the container, to allow a person's head to remain upright (i.e., minimizing or no tilting head movement) while drinking and not impede the user's straight-ahead vision, such as while driving. The mouthpiece MP becomes disposed at one side of the nose so that the container is tiltable further relative to the person's head as the nose does not interfere with the tilting action. Although the mouthpiece MP is illustrated integral with the annular body, the mouthpiece MP can be separately formed and attached. In particular, the mouthpiece can be detachably connected so that different mouthpiece configurations can be attached according to the drinker's preference.

Figure 5:
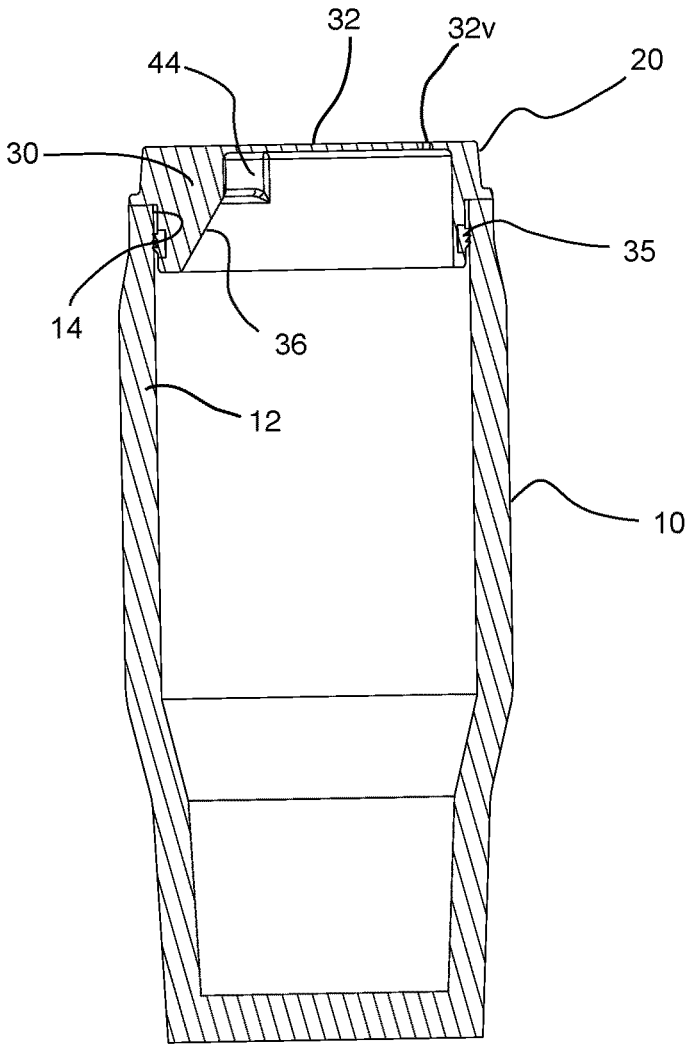
FIG. 5 illustrates an elevational cross-sectional view taken along the line 5-5 in FIG. 1, illustrating the cross-sectional view of the entire assembly along the length thereof.

Referring to FIGS. 4 and 5, which respectively show an elevational cross-sectional view taken along the line 4-4 in FIG. 2 and an elevational cross-sectional view taken along the line 5-5 in FIG. 1, the lid 20 includes an annular (hollow) body 30 a closed upper end and an open lower end to define a cavity or a chamber 31. A top wall 32 closes the upper end of the annular body 30. Specifically, the top wall can be disposed within, or on top of the upper end of, the annular body, and can extend in a substantially horizontal direction relative to the upper and lower ends. Specifically, the top wall 32, which can have a circular plate configuration, is disposed to close the upper end of the annular body, not withstanding a small vent opening 32*v* extending through the top wall. The annular body 30 and the top wall 32 define the chamber 31 that faces the opening of the container when the lid is attached to the container. The term "annular" refers to a hollow configuration, and not necessarily to a perfectly circular ring configuration such as a cylindrical pipe or tube.

Referring again to FIGS. 2-3, the annular body 30 includes a coupling 30C configured to removably and sealingly attach the annular body 30 to a wall 12 of the opening 14 of the container 10, from the side of the open lower end of the annular body, so that the chamber 31 faces the opening 14 of the container 10 when the annular body 30 is attached to the wall of the container. The chamber 31 faces the opening of the container when the annular body is attached to the wall of the container.

Specifically, referring to FIGS. 2-3, 5, and 5A, the annular body 30 includes, at its lower portion, a push-mount (friction fit) coupling 30C configured to removably and sealingly secure to the wall 12 defining the opening 14 of the container 10. More specifically, the annular body 30 has, at its outer side and at its lower portion, above the lower end, at least one groove or recess 34 configured to seat, at least one o-ring or a seal 35, which can be made of food grade silicon. The o-ring 35 provides a sealing friction fit against the inner wall surface that defines the opening of the container to secure the lid to the container.

Although the present embodiments illustrate the coupling 30C shaped as a circular cylinder, it can have a different shape, such as oval, square, rectangular, triangular, pentagonal, hexagonal, etc., complementary with the shape of the container opening. That is, the coupling 30C can have any configuration suitable for securing to the container. For example, referring to FIG. 9, the coupling 30C of the lid 20 can have a screw-mount configuration. Specifically, instead of the recess 34, the coupling 30C has, at its outer side, screw threading 34*s* to mate with complementary threading provided on the container. Alternatively, the coupling can be a bayonet-type that allows the lid to be secured by a twist.

Referring again to FIGS. 7-8, which respectively show a cross-sectional view taken along the line 7-7 in FIG. 3 and a cross-sectional view taken along the line 8-8 in FIG. 3, and FIGS. 4-5A, a sloped surface (ramp) 36 can be disposed in the annular body 30. Specifically, the annular body 30 includes, at its inner wall side, a ramp defined by a sloped surface 36 that is configured to guide liquid from the container to the mouthpiece. Specifically, the side-wall thickness of the annular body 30, from its open lower end increases over a predetermined length/height thereof and along a predetermined circumferential or peripheral length to assist flow of liquid to the mouthpiece. That is, the wall surface of the annular body forms the ramp 36. The sloping surface of the ramp slopes relative to a first (e.g., vertical) direction extending between the closed upper end and the open lower end of the annular body. Specifically, the side wall thickness of the annular body increases along the first direction, from the open lower end toward a channel 44, to provide the sloping surface of the ramp 36 that ends near or adjacent to the opening of the channel 44.

The mouthpiece MP has a drink opening 42 and the channel 44 that extends from the drink opening 42 to the chamber 31, in particular to the upper end of the ramp, to direct liquid from the container to flow out of the drink opening 42 upon tilting the bottom of the container upwardly in relation to the mouthpiece MP. Specifically, the channel 44 is disposed in at least one of the annular body or the mouthpiece, and extends between the drink opening 42 and the chamber 31 to fluidly communicate between the drink opening and the chamber.

The channel 44 has a first open end facing the chamber 31 and a second open end that communicates with the drink opening 42 or integrated with the drink opening 42, and can be funnel shaped, with the first open end being wider than the second open end. The first open end of the channel 44 is disposed adjacent to and laterally on one side the ramp 36 to permit liquid to flow sideways in relation to the first direction extending between the closed upper end and the open lower end. Moreover, the first and second open ends can be disposed substantially perpendicular to each other.

The drink opening 42 can open in the first direction, namely upwardly, in the same direction of the opening of the container, but offset from the opening of the container. That is, the drink opening 42 opens in a direction that is parallel to the axial or longitudinal direction of the container and offset from it sideways. Moreover, the drink opening 42 can be disposed substantially perpendicular to the longitudinal direction of the channel. The mouthpiece is configured to extend laterally beyond a widest portion of the beverage container to allow the beverage container to be positioned at one side of a drinker's nose while consuming beverage through the mouthpiece.

The closed upper end or the top wall 32 has a vent opening 32*v* suitably located so that liquid does not interfere with its function of communicating air between the ambient and inside the container. In this respect, the vent opening 32*v* can be disposed farthest away from the ramp area. An air permeable membrane (not shown) can be included to cover the vent opening to keep foreign elements from entering the container.

Referring to FIGS. 2, 7, and 8 in particular, the mouthpiece MP extends laterally outwardly at an angle in relation to the position of the lid when a person is consuming the beverage through the drink opening 42. As seen from FIG. 7, the end (edge where the ramp meets the top wall 32) of the surface of the ramp 36 is tilted relative to the horizontal (illustrated as a dashed line) and extends substantially parallel with the longitudinal direction of the channel 44. This allows the gravity to assist flow of liquid to the drink opening 42.

As more clearly shown in FIG. 8, at least one of the sloping surface of ramp or the longitudinal direction of the channel is angled relative to an elongation direction of the drink opening 42 to assist flow of liquid from the chamber to the drink opening. Specifically, the drink opening 42 is shown extending parallel to the horizontal line while the longitudinal direction of the channel 44 is at an angle relative to the horizontal direction. That is, the direction of the elongation of the drink opening 42 is illustrated in the horizontal direction. The longitudinal direction of the channel 44 is angled relative to the elongation direction of the drink opening 42. That is, the elongation direction of the drink opening and the longitudinal direction of the channel, as well as the end of the ramp, are not parallel. Moreover, while the drink opening 42 can have any suitable configuration, the drawings illustrate an oval shape as an example.

Figure 2A:
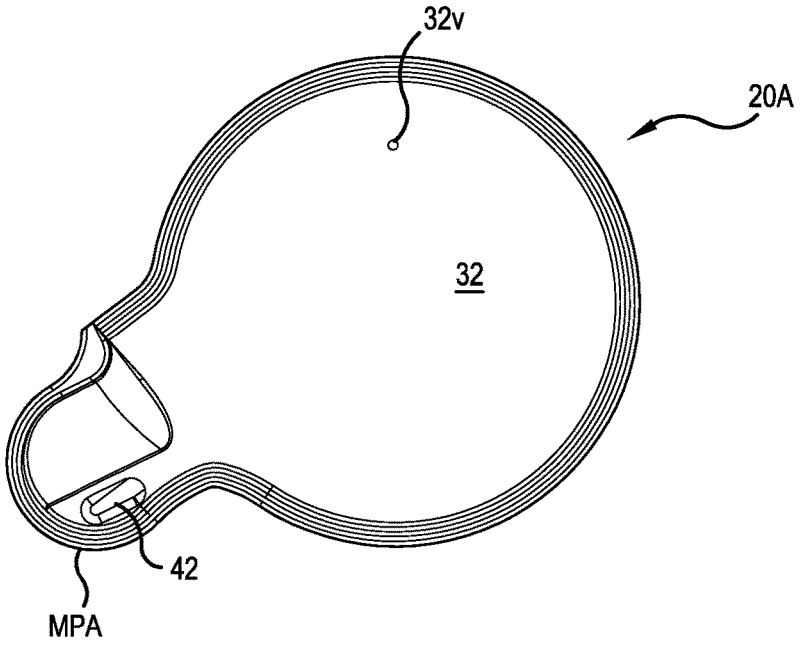
FIG. 2A illustrates another embodiment of the lid, namely a top view of the lid similar to FIG. 2, but with the mouthpiece angled.

FIG. 2A illustrates an alternative embodiment of the lid 20A where the mouthpiece MPA is angled relative to the annular body 30 and can extend further out, in comparison to the embodiment of the lid 20 illustrated in FIG. 2. Specifically, the drink opening 42 is angled further in relation to the annular body than the embodiment of FIG. 2. Otherwise, the embodiment of FIG. 2A has the same features as the embodiment of FIG. 2.

The mouthpiece also can have a small reservoir (not illustrated) above the drink opening that communicates with the container so that the beverage can accumulate in the reservoir. In another embodiment, the mouthpiece can be raised above the outermost surface of the top wall. The mouthpiece also can be configured from a malleable material to allow for more flexibility and convenience in drinking.

In the illustrated embodiment, the mouthpiece is configured to extend from the left side of the container, suitable for drivers where the steering wheel is at the left side of the vehicle, such as in the U.S. For drivers where the steering wheel is at the right side of the vehicle, such as in the U.K., the mouthpiece can be configured to extend from the right side of the container.

FIGS. 11-12 respectively illustrate a perspective view of the lid 20 of FIG. 1, with a cap 22 for protecting, namely covering and sealing the drink opening 42, and a top view of the lid 20 shown in FIG. 11. The cap is dimensioned to be larger than the opening and has a plug (not illustrated) having a dimension that is complementary with the drink opening 42 so that it sealingly plugs the drink opening 42. A retaining strap 23 can be attached to or integrally formed at the underside of the mouthpiece MP to hold the cap. The retaining strap 23 also can be removably attached. For instance, the underside of the mouthpiece MP can have a downwardly depending stud with a larger head disposed at the free end thereof. The side of the retaining strap to be attached to the lid can have an opening, such as a slit, that allows the stud to pass therethrough and securely retain the retaining strap 23. The cap and strap can be made integrally formed of a resilient material, such as silicon. The cap makes it easier to carry the container assembly SS while walking or being stowed in a bag.

FIGS. 13-16 illustrate another embodiment of the lid shown in FIGS. 1-12, but having a larger drink opening 42A and channel 44A suitable for pouring room temperature and cooled liquid. The same or similar references are used to depict similar or same elements. In this embodiment, as evident from FIG. 13 in particular, the mouthpiece MPL has a substantially larger opening 42A, which can be similar in size as a conventional water bottle opening. In this respect, the channel 44A, which extends from the drink opening 42A to the chamber 31 (see FIG. 4), is larger to direct a greater volume of liquid from the container to flow out of the drink opening 42A upon tilting the bottom of the container upwardly in relation to the mouthpiece.

Figure 19:
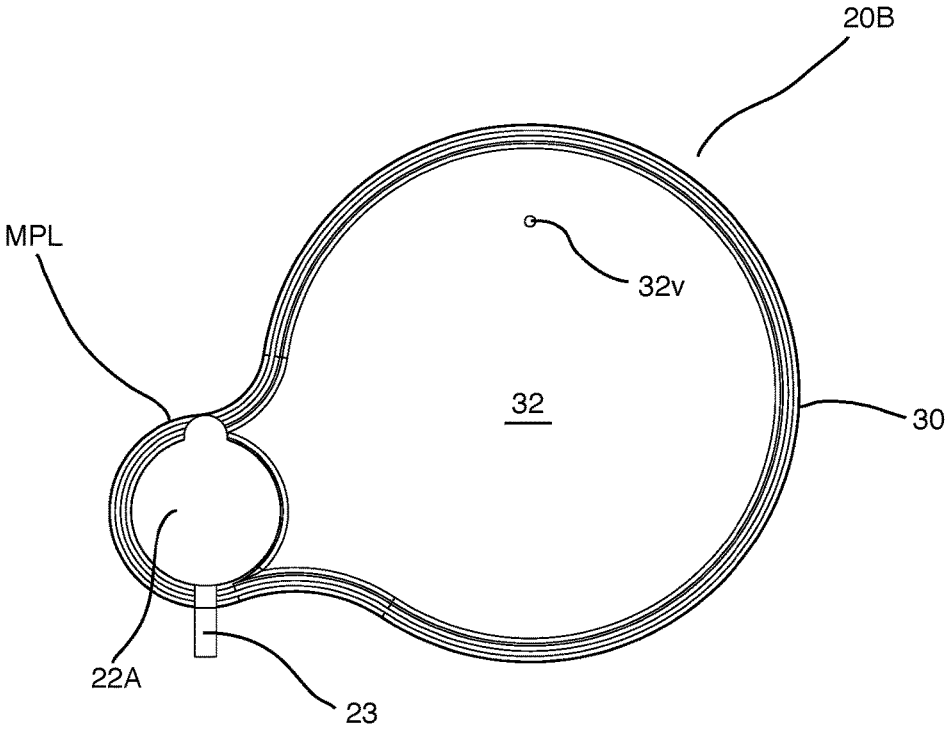
FIG. 19 illustrates a top view of the lid shown in FIG. 18.
Figure 20A:
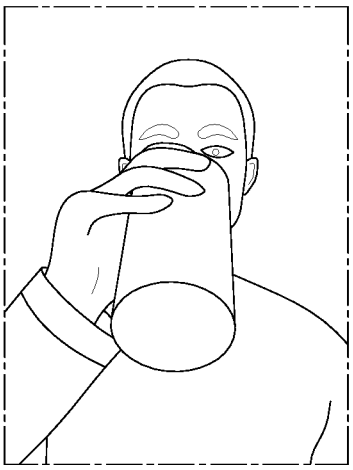
FIG.20A (Prior Art)
FIGS. 20A and 20B respectively are the front and side views schematically illustrating the angle of the container in relation to the person's head when the drink starts to flow.
Figure 20B:
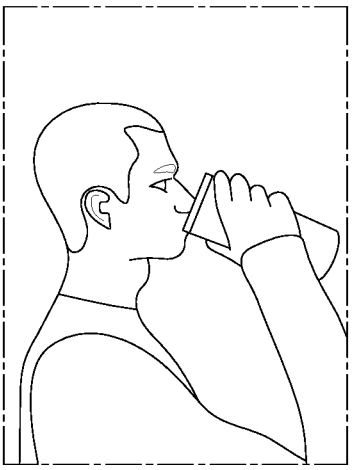
FIG.20B (Prior Art)
Figure 21A:
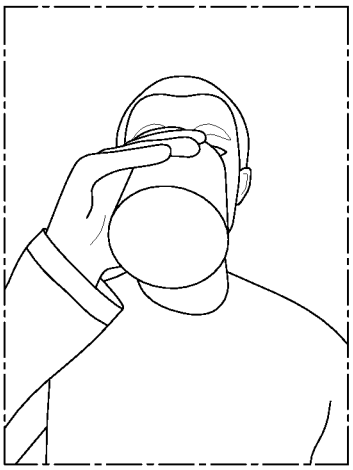
FIG.21A (Prior Art)
FIGS. 21A and 21B respectively are the front side views schematically illustrating the angle of the container in relation to the person's head when the drink enters the person's mouth and the nose is touching the container's top.
Figure 21B:
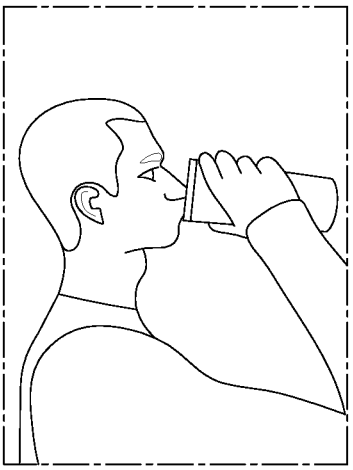
FIG.21B (Prior Art)
Figure 22A:
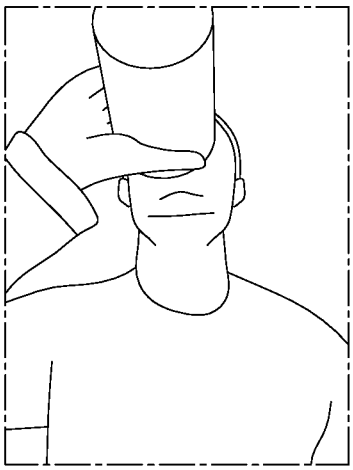
FIG.22A (Prior Art)
FIGS. 22A and 22B respectively are the front and side views schematically illustrating the person's head tilting back to finish the drink.
Figure 22B:
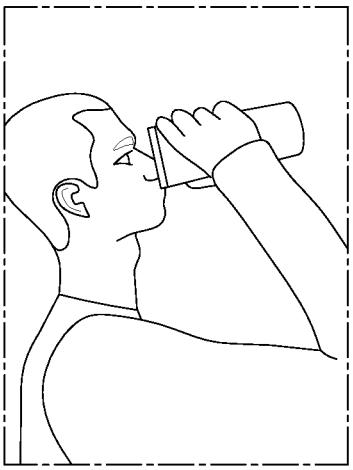
FIG.22B (Prior Art)
Figure 23A:
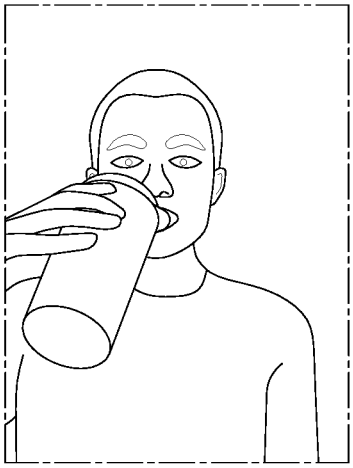
FIGS. 23A and 23B respectively are the front and side views schematically illustrating the angle of the container in relation to the person's head when the drink starts to flow when drinking from the present container assembly.
Figure 23B:
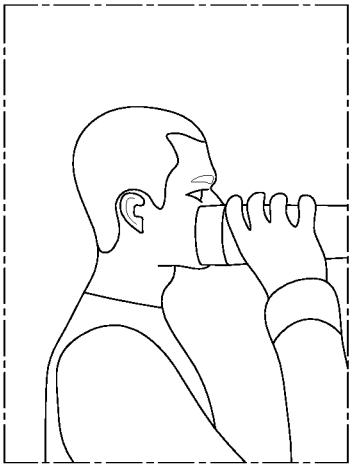

FIGS. 18-19 are similar to FIGS. 11-12 in that they respectively illustrate a perspective view of the lid 20B of FIG. 13, with a cap 22A for protecting, namely covering and sealing the drink opening 42A, and a top view of the lid 20B shown in FIG. 13. Again, the cap 22A can be dimensioned larger than the opening 42A and also can have a plug (not illustrated) having a dimension that is complementary with the drink opening 42A so that it sealingly plugs into the drink opening 42A. Alternatively, the cap have be dimensioned to sealingly attach to the outer circumferential wall surface 43W (see FIG. 15) defining the drink opening 42A, similarly as configured in commercially sold gallon sized water containers.

The lid 20, 20A, 20B can be made of a dishwasher-safe plastic, free of bisphenol-a (BPA), or food grade stainless steel, as some examples. The lid, if made from plastic, can be formed by injection molding.

Figure 5A:
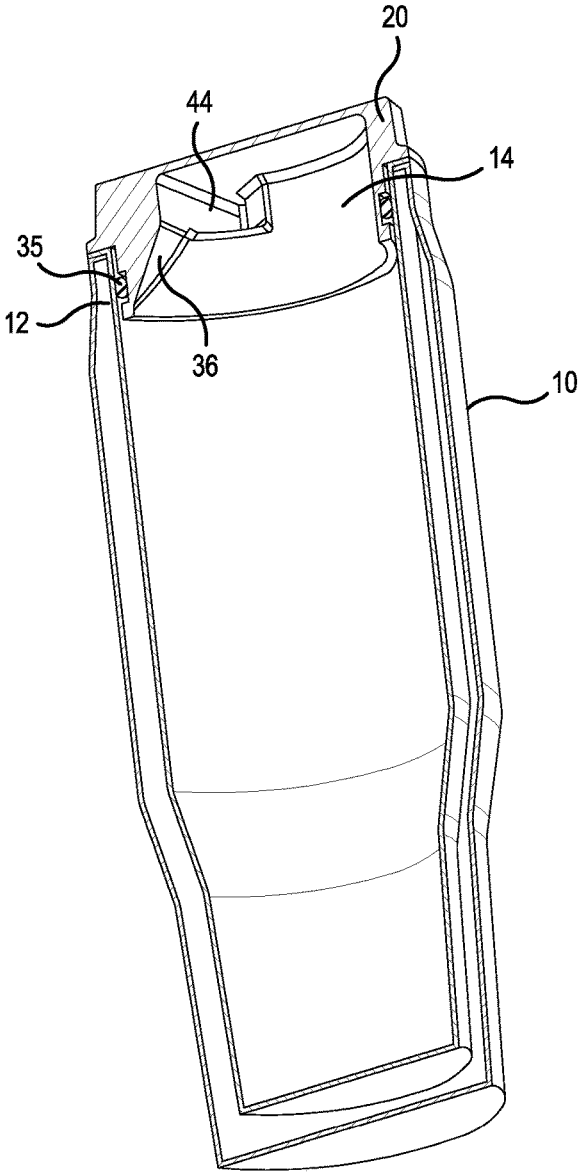
FIG. 5A illustrates a perspective cross-sectional view of FIG. 5, but illustrating a vacuum insulated container.

The container 10 in FIG. 5 is illustrated as having a solid wall 12. But as illustrated in FIG. 5A, the container can be vacuum insulated. The wall 12 has a double-wall configuration, an inner wall that holds the liquid and an outer wall that is spaced from the inner wall. The air normally occupied in the space between the inner and outer walls are removed to provide insulation. The container can be any commercially available container.

Figure 24A:
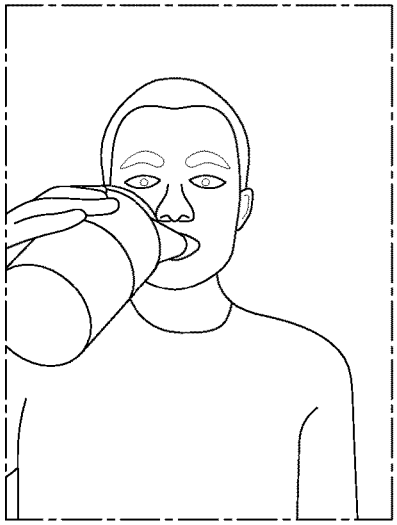
FIGS. 24A and 24B respectively are the front and side views schematically illustrating the angle of the container in relation to the person's head when the drink enters the person's mouth when drinking from the present container assembly.
Figure 24B:
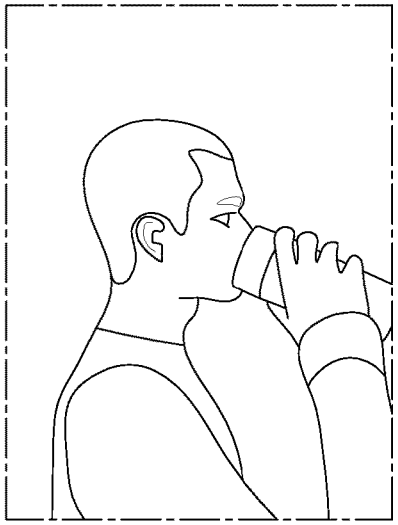
Figure 25A:
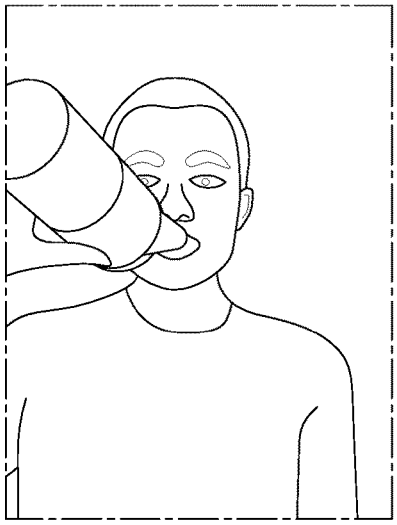
FIGS. 25A and 25B respectively are the front and side views schematically illustrating the person's head to finish the drink when drinking from the present container assembly.
Figure 25B:
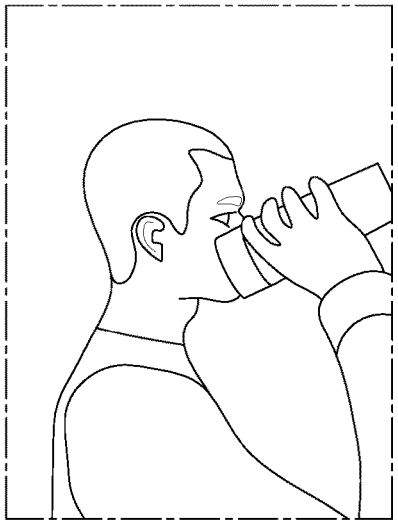

The mouthpiece MP is configured to allow the container to be tilted upwardly relative to the mouthpiece MP so that the container becomes positioned at one side of a drinker's nose while consuming liquid through the mouthpiece MP. Specifically, when a person is drinking liquid from the container assembly SS, he/she places the mouth to cover the drink opening 42, 42A while the container assembly SS is substantially upright. The person would then tilt the bottom of the container 10 upwardly in relation to the mouthpiece, such as shown in FIGS. 23A-25B, while being able to keep his/her head substantially in a stationary upright or erect position. Specifically, FIGS. 23A and 23B respectively are the front and side views schematically illustrating the angle and position of the container in relation to the person's head when the drink starts to flow when drinking from the present container assembly. Note that the person's head remains upright and the container does not impair the person's straight-ahead visibility. FIGS. 24A and 24B respectively are the front and side views schematically illustrating the angle and position of the container in relation to the person's head when the drink enters the person's mouth when drinking from the present container assembly. Note that the person's head remains upright and the container still does not impair the person's straight-ahead visibility. FIGS. 25A and 25B respectively are the front and side views schematically illustrating the person's head to finish the drink when drinking from the present container assembly. Again, that the person's head can remain upright and the container still does not impair the person's straight-ahead visibility from at least the left eye, while the container may partially block the right eye's straight-ahead vision. Elongating the mouthpiece MP farther can ensure that the container does not block the right eye's straight-ahead vision.

As the container is being tilted, the liquid from the container flows over the ramp 36, in the first direction, substantially along the longitudinal direction of the container. Because the ramp 36 is disposed adjacent to opening of the channel 44, 44A (and tilted toward the channel 44), liquid flows substantially sideways or laterally to one side into the channel 44, 44A. As the drink opening opens upwardly parallel to the longitudinal direction of the container 10, the liquid flows out of the drink opening into the mouth of the person. This permits the liquid to flow offset from the container to allow the person to maintain his/her head upright, without the need to tilt the head backwards, as the container is disposed one side of the nose and clearing the nose so that the container can be tilted further back as the nose will not obstruct the container.

Given the present disclosure, one versed in the art would appreciate that there may be other embodiments and modifications within the scope and spirit of the present invention. Accordingly, all modifications attainable by one versed in the art from the present disclosure within the scope and spirit of the present invention are to be included as further embodiments of the present invention. The scope of the present invention accordingly is to be defined as set forth in the appended claims.

What is claimed is:

1. A lid comprising:

an annular body with a closed upper end and an open lower end to define a chamber;

a mouthpiece extending laterally outwardly from a side of the annular body and having a drink opening; and a channel disposed in at least one of the annular body or the mouthpiece, and extending between the drink opening and the chamber to fluidly communicate between the drink opening and the chamber, wherein the drink opening is disposed substantially perpendicular to a longitudinal direction of the channel.

2. The lid according to claim 1, wherein the channel has a first open end facing the chamber and a second open end that communicates with the drink opening.

3. The lid according to claim 2, further comprising:

a ramp disposed in the annular body, wherein the ramp has a sloping surface that slopes relative to a first direction extending between the closed upper end and the open lower end of the annular body.

4. The lid according to claim 3, wherein a side wall thickness of the annular body increases along the first direction, from the open lower end toward the channel, to provide the sloping surface.

5. The lid according to claim 3, wherein the first open end of the channel is disposed adjacent to and laterally on one side the ramp to permit liquid to flow substantially sideways in relation to the first direction.

6. The lid according to claim 1, wherein:

the drink opening is elongated, an elongation direction of the drink opening is angled relative to the longitudinal direction of the channel.

7. The lid according to claim 1, wherein the drink opening opens in a first direction extending between the closed upper end and the open lower end.

8. The lid according to claim 2, wherein the first and second open ends are disposed substantially perpendicular to each other.

9. The lid according to claim 2, wherein the channel is funnel shaped, with the first open end being wider than the second open end.

10. The lid according to claim 1, further comprising:

a coupling configured to removably and sealingly attach the annular body, from the side of the open lower end, to a wall of an opening of a container, wherein the chamber faces the opening of the container when the annular body is attached to the wall of the container.

11. The lid according to claim 10, wherein the mouthpiece is configured to allow the container to be tilted upwardly relative to the mouthpiece so that the container becomes positioned at one side of a drinker's nose while consuming liquid through the mouthpiece.

12. The lid according to claim 11, wherein the mouthpiece is integral with the annular body.

13. A container assembly comprising:

a container having an opening; and a lid configured to cover the opening and comprising:

an annular body with a closed upper end and an open lower end to define a chamber;

a mouthpiece extending laterally outwardly from a side of the annular body and having a drink opening; and a channel disposed in at least one of the annular body or the mouthpiece, and extending between the drink opening and the chamber to fluidly communicate between the drink opening and the chamber, wherein the drink opening is disposed substantially perpendicular to a longitudinal direction of the channel.

14. The container assembly according to claim 13, wherein the channel has a first open end facing the chamber and a second open end that communicates with the drink opening.

15. The container assembly according to claim 14, further comprising:

a ramp disposed in the annular body, wherein the ramp has a sloping surface that slopes relative to a first direction extending between the closed upper end and the open lower end of the annular body.

16. The container assembly according to claim 15, wherein a side wall thickness of the annular body increases along the first direction, from the open lower end toward the channel, to provide the sloping surface.

17. The container assembly according to claim 15, wherein the first open end of the channel is disposed adjacent to and laterally on one side the ramp to permit liquid to flow substantially sideways in relation to the first direction.

18. The container assembly according to claim 13, wherein:

the drink opening is elongated, an elongation direction of the drink opening is angled relative to the longitudinal direction of the channel.

19. The container assembly according to claim 13, further comprising:

a coupling configured to removably and sealingly attach the annular body, from the side of the open lower end, to a wall of the opening of the container, wherein the chamber faces the opening of the container when the annular body is attached to the wall of the container.

20. The container according to claim 19, wherein the mouthpiece is configured to allow the container to be tilted upwardly relative to the mouthpiece so that the container becomes positioned at one side of a drinker's nose while consuming liquid through the mouthpiece.

* * * * *